US012584287B2

(12) United States Patent
Narayanan et al.

(10) Patent No.: US 12,584,287 B2
(45) Date of Patent: Mar. 24, 2026

(54) RECONFIGURABLE GRADING BLADE ATTACHMENT WITH A STABILIZER WHEEL ASSEMBLY ON A WORK MACHINE

(71) Applicant: Deere & Company, Moline, IL (US)

(72) Inventors: Arun Narayanan, Pune (IN); Mark A. Simon, Dubuque, IA (US); Nicholas J. Rokusek, Dubuque, IA (US); Brett S. Graham, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 405 days.

(21) Appl. No.: 18/500,245

(22) Filed: Nov. 2, 2023

(65) Prior Publication Data

US 2025/0146249 A1 May 8, 2025

(51) Int. Cl.

| | |
|---|---|
| ***E02F 3/815*** | (2006.01) |
| ***E02F 3/36*** | (2006.01) |
| ***E02F 3/76*** | (2006.01) |
| ***E02F 3/84*** | (2006.01) |

(52) U.S. Cl.

CPC ..... *E02F 3/8152* (2013.01); *E02F 3/844* (2013.01)

(58) Field of Classification Search

CPC ..... E02F 3/8152; E02F 3/844; E02F 3/8155; E02F 3/7672; E02F 3/7622; E02F 3/7677; E02F 3/34; E02F 3/7663; E02F 3/7631

See application file for complete search history.

(56) References Cited

U.S. PATENT DOCUMENTS

| | | | | |
|---|---|---|---|---|
| 3,448,814 | A | 6/1969 | Bentley et al. | |
| 3,776,318 | A | 12/1973 | Layton | |
| 4,026,365 | A | 5/1977 | Andersson et al. | |
| 5,165,191 | A | 11/1992 | Davis | |
| 6,168,348 | B1 * | 1/2001 | Meyer | E02F 3/7663 404/90 |
| 6,425,196 | B1 | 7/2002 | Weagley et al. | |
| 7,021,398 | B1 | 4/2006 | Marshall | |
| 9,526,204 | B2 | 12/2016 | Rude et al. | |

(Continued)

FOREIGN PATENT DOCUMENTS

DE 1023975 B 2/1958

OTHER PUBLICATIONS

German Search Report issued in application No. 102024128396.3 dated May 12, 2025, 08 pages.

*Primary Examiner* — Joseph M Rocca
*Assistant Examiner* — Robert E Pezzuto

(57) ABSTRACT

A reconfigurable grading blade attachment for a work machine includes an attachment frame, a pivot beam extending transversely to the frame length, a left stabilizer wheel assembly pivotally coupled to the left portion of the pivot beam, a right stabilizer wheel assembly pivotally coupled to a right portion of the pivot beam, a center mount, a left hydraulic actuator pivotally coupled to the left portion of the pivot beam, a right hydraulic actuator pivotally coupled to the right portion of the pivot beam, and a grading blade extending transversely to the length of the work machine frame. Retraction of the left hydraulic actuator rotates the left stabilizer wheel assembly upwards about the left wheel lift axis. Retraction of the right hydraulic actuator rotates the right stabilizer wheel assembly upwards about the right wheel lift axis.

20 Claims, 9 Drawing Sheets

(56) References Cited

U.S. PATENT DOCUMENTS

| | | | | |
|---|---|---|---|---|
| 9,896,817 | B2 | 2/2018 | Sulzer et al. | |
| 10,676,894 | B2 | 6/2020 | Sharp | |
| 11,019,770 | B2 | 6/2021 | Brimeyer et al. | |
| 2003/0136568 | A1* | 7/2003 | McReynolds | E02F 3/34 172/253 |
| 2009/0119954 | A1 | 5/2009 | Lemieux et al. | |
| 2024/0026636 | A1* | 1/2024 | Sharp | E02F 3/7668 |

* cited by examiner

RECONFIGURABLE GRADING BLADE ATTACHMENT WITH A STABILIZER WHEEL ASSEMBLY ON A WORK MACHINE

CROSS-REFERENCE TO RELATED APPLICATIONS

N/A

TECHNICAL FIELD

The present disclosure relates generally to a work machine with a reconfigurable grading blade attachment with a stabilizer wheel assembly.

BACKGROUND

Compact construction work machines have expanded their functions to include grade control, especially in confined spaces such as residential areas. Grader blades may use a stabilizer wheel to minimize blade fluctuation when maneuvering over a contoured surface. The stabilizer wheel can aid in achieving a smoother finish of the graded surface. However, the position of the stabilizer wheel may limit the performance of the grader blade due to a maximum allowable speed and potential interference of the wheel with obstructions along the travel path. Therein lies an opportunity to improve the configuration of the stabilizer wheel grader blade coupling to enable a broader application of the tool with ease while maintaining the accuracy.

SUMMARY

According to an aspect of the present disclosure, a reconfigurable grading blade attachment for a work machine is disclosed. The attachment includes an attachment frame with an upper attachment portion and a rear attachment frame portion wherein the upper attachment frame portion has a frame length extending forward from the rear attachment frame portion. The attachment also includes a coupler bracket that includes an attachment interface for coupling the grading blade attachment to the work machine. The attachment further comprises a pivot beam, a left stabilizer wheel assembly, a right stabilizer wheel assembly, a center mount, a left hydraulic actuator, a right hydraulic actuator, and a grading blade. The coupler bracket includes an attachment interface for coupling the grading blade attachment to the work machine. The pivot beam extends transversely to the frame length and is pivotally coupled to the upper attachment frame portion such that the pivot beam is pivotable about a pivot beam axis relative to the upper attachment frame portion. The pivot beam has a left portion and a right portion on opposite sides of the pivot beam axis. The left stabilizer wheel assembly is pivotally coupled to the left portion of the pivot beam and pivots about a left wheel lift axis. The right stabilizer wheel assembly is pivotally coupled to the right portion of the pivot beam and pivots about a right wheel lift axis. The center mount extends vertically from the pivot beam. The left hydraulic actuator is coupled to the center mount on a first end and coupled to the left stabilizer wheel assembly on a second end, wherein retraction of the left hydraulic actuator rotates the left stabilizer wheel assembly upwards about the left wheel lift axis. The right hydraulic actuator is coupled to the center mount on a third end and is pivotally coupled to the right stabilizer wheel assembly on a fourth end, wherein retraction of the right hydraulic actuator rotates the right stabilizer wheel assembly upwards about the right wheel lift axis. The grading blade extends transversely to a length of the work machine frame.

The center mount may further comprise of a sliding mechanism of a forward extending protrusion from the center mount seated within a vertical slide notch located within a center mount cover to prevent the center mount from moving transverse to the upper attachment frame portion during an operation of the left hydraulic actuator or the right hydraulic actuator.

The grading blade attachment may further comprise of a mechanical lock consisting of a first aperture on the pivot beam, a second aperture on the stabilizer wheel assembly, and a locking pin adapted to engage the first aperture and the second aperture to lock the stabilizer wheel assembly in a downward position.

The grading blade attachment may further comprise of a one or more of a hydraulic lock and a soft lock mechanism wherein the left hydraulic actuator and the right hydraulic actuator are communicatively coupled to a controller on the work machine. The controller is configured to transmit a lock signal upon a user input request from a user input interface to inactivate a portion of a hydraulic system related to movement of the left hydraulic actuator and the right hydraulic actuator.

The left hydraulic actuator and the right hydraulic actuator are communicatively coupled to a controller. The controller is configured to selectively activate a portion of a hydraulic system related to movement of the left hydraulic actuator and the right hydraulic actuator upon a user input request from a user input interface.

The upper attachment frame portion is a single-piece component.

The grading blade is a grading box.

In another embodiment, the grading blade attachment may further include the left hydraulic actuator and the right hydraulic actuator which are communicatively coupled to a controller. The controller is configured to selectively activate a portion of a hydraulic system related to movement of the left hydraulic actuator and the right hydraulic actuator in response to an object detection system.

The grading blade attachment may further comprise of a mechanical lock consisting of a first aperture on the pivot beam, a second aperture on the hydraulic actuator, and a locking pin adapted to engage the first aperture and the second aperture to lock the stabilizer wheel assembly in a downward position.

The upper attachment frame portion is not foldable.

Other features and aspects will become apparent by consideration of the detailed description, claims, and accompanying drawings.

BRIEF DESCRIPTION OF THE DRAWINGS

The detailed description of the drawings refers to the accompanying figures.

Like reference numerals are used to indicate like elements throughout the several figures.

DETAILED DESCRIPTION

Figure 1:
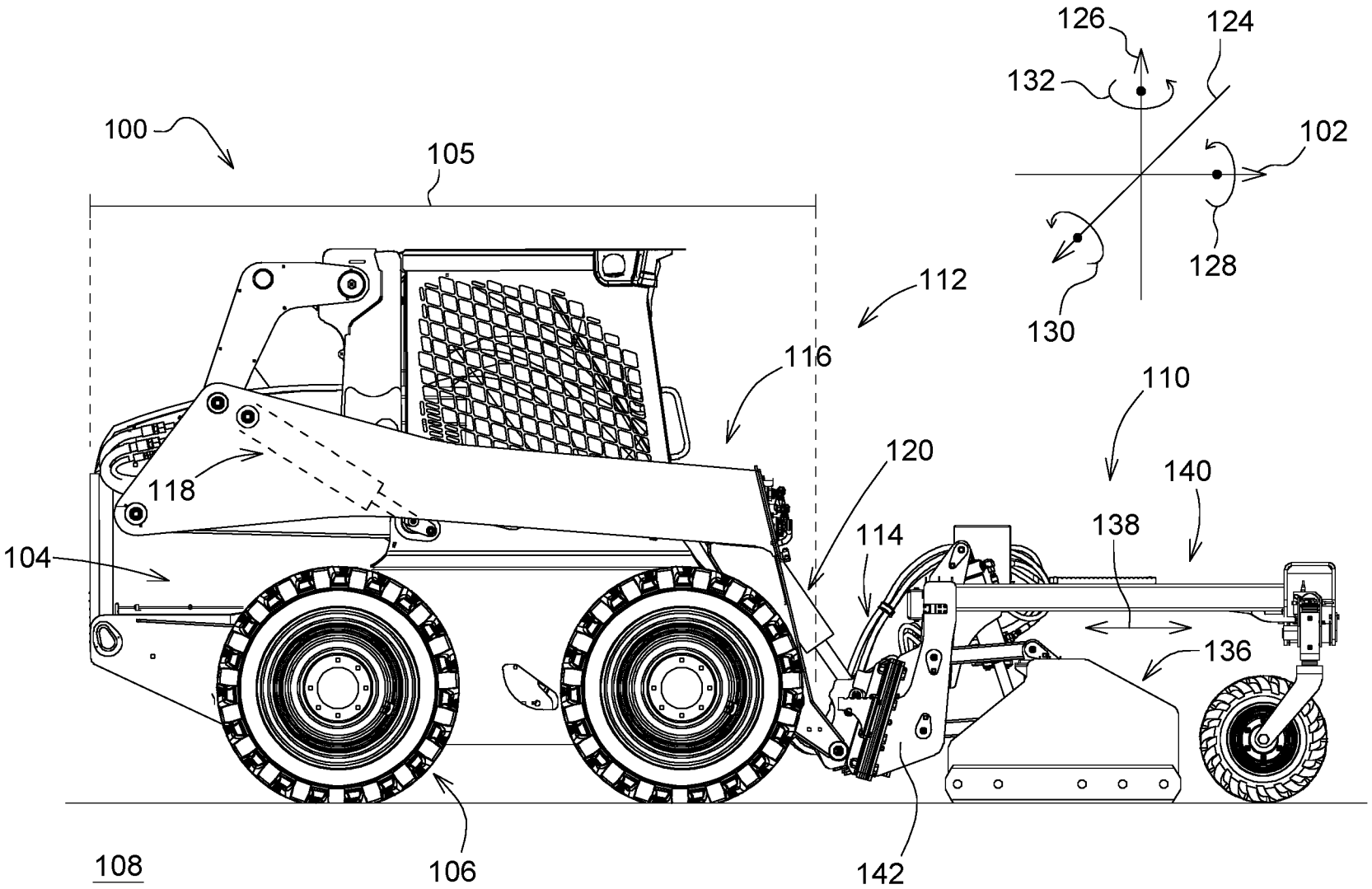
FIG. 1 is a side view of a work machine of the reconfigurable grading blade attachment with the stabilizer wheels in a downward position.

As used herein, "e.g." is utilized to non-exhaustively list examples and carries the same meaning as alternative illustrative phrases such as "including," "including, but not limited to," and "including without limitation." Unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Terms of degree, such as "generally", "substantially" or "approximately" are understood by those of ordinary skill to refer to reasonable ranges outside of a given value or orientation, for example, general tolerances or positional relationships associated with manufacturing, assembly, and use of the described embodiments.

As used herein, "controller" is intended to be used consistent with how the term is used by a person of skill in the art, and refers to a computing component with processing, memory, and communication capabilities, which is utilized to execute instructions (i.e., stored on the memory or received via the communication capabilities) to control or communicate with one or more other components. In certain embodiments, the controller may be configured to receive input signals in various formats (e.g., hydraulic signals, voltage signals, current signals, CAN messages, optical signals, radio signals), and to output command or communication signals in various formats (e.g., hydraulic signals, voltage signals, current signals, CAN messages, optical signals, radio signals).

The controller may be in communication with other components on the work machine, such as hydraulic components, electrical components, and operator inputs within an operator station of an associated work machine. The controller may be electrically connected to these other components by a wiring harness such that messages, commands, and electrical power may be transmitted between the controller and the other components. Although the controller is referenced in the singular, in alternative embodiments the configuration and functionality described herein can be split across multiple devices using techniques known to a person of ordinary skill in the art. The controller 84 includes the tangible, non-transitory memory 85 on which are recorded computer-executable instructions, including a predictive maintenance for a track chain undercarriage algorithm. The processor of the controller is configured for executing the predictive maintenance algorithm.

The controller may be embodied as one or multiple digital computers or host machines each having one or more processors, read only memory (ROM), random access memory (RAM), electrically-programmable read only memory (EPROM), optical drives, magnetic drives, etc., a high-speed clock, analog-to-digital (A/D) circuitry, digital-to-analog (D/A) circuitry, and any required input/output (I/O) circuitry, I/O devices, and communication interfaces, as well as signal conditioning and buffer electronics.

Figure 2:
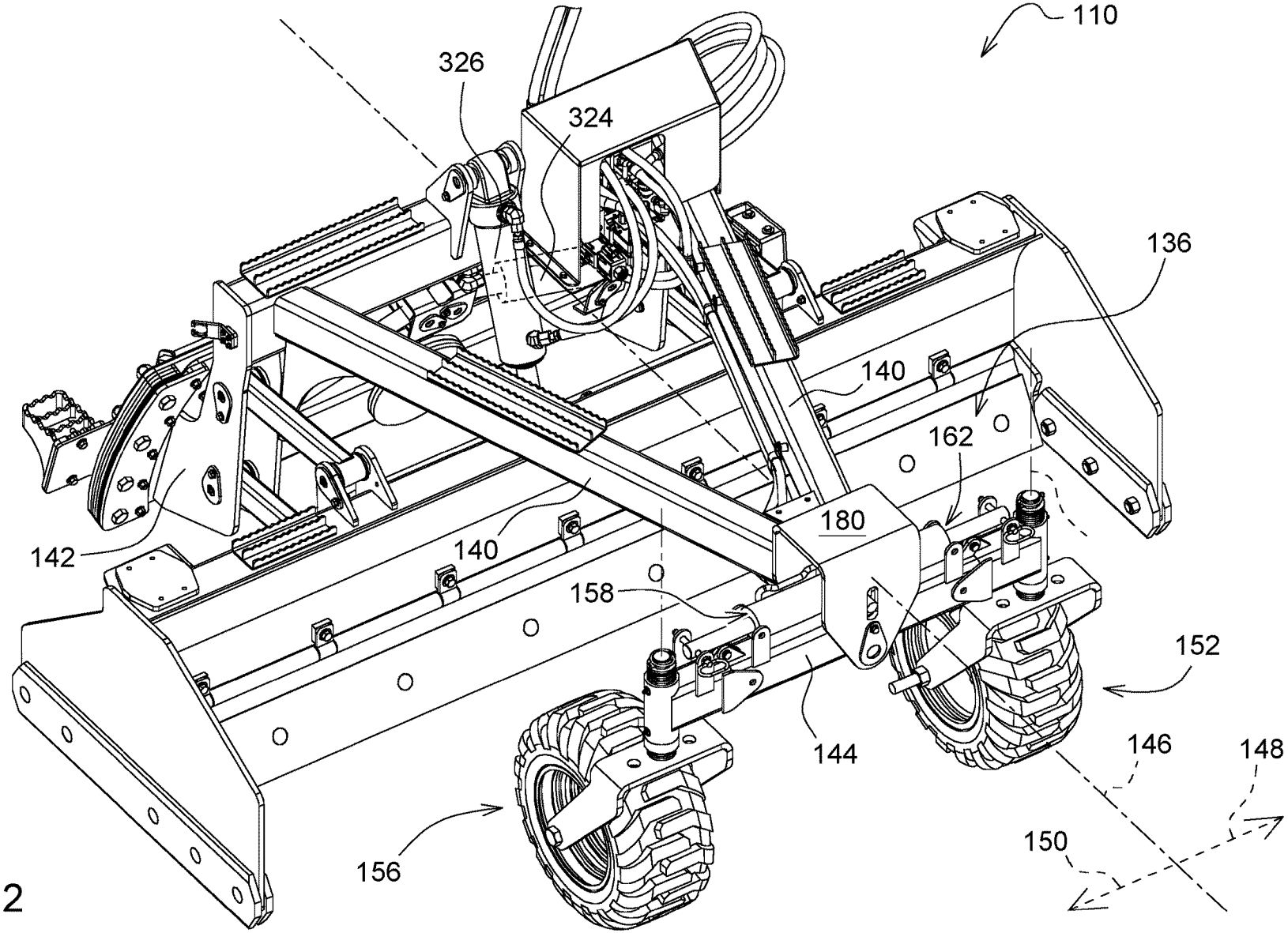
FIG. 2 is an isometric front view of the reconfigurable blade attachment with the stabilizer wheels in a downward position.

FIGS. 1 and 2 illustrate a work machine 100, depicted as a skid steer with an attachment 110 operatively coupled to the work machine in a fore direction 102. It should be understood, however, that the work machine 100 could be one of many work machines, including, and without limitation, a compact track loader, a front loader, and other construction work machines that use a stabilizer wheel. The work machine shown here has a frame 104 with ground-engaging units 106 configured to support the frame 104 on a ground surface 108. The illustrated ground-engaging units 106 comprises of tracks, but other embodiments can include wheels that engage the surface. Work machines include an attachment to allow an operator to engage the surface and cut and move material achieve simple or complex features on the surface. As used herein, directions with regard to the work machine may be referred to from the perspective of facing towards the attachment 110 from the frame 104 of the work machine.

Referring to FIG. 1, the work machine 100 comprises of a boom assembly 112 pivotally coupled to the frame 104. A reconfigurable attachment 110, or more specifically, a grading blade attachment 110 is pivotally coupled at a forward portion of the boom assembly 112. The grading blade attachment 110 is coupled to the boom assembly 112 through an attachment coupler 114, such as Deere and Company's Quik-Tach, which is an industry standard coupler configuration universally applicable to many Deere attachments and several after-market attachments.

The boom assembly 112 comprises of a pair of boom arms 116 pivotally coupled to the frame 104 and moveable relative to the frame 104 by a pair of boom hydraulic actuators 118. The attachment coupler 114 is coupled to a distal portion of the boom arms 116 and is moveable relative to the frame 104 by a pair of pitch hydraulic actuators 120. For this embodiment, each of the pair of boom hydraulic actuators 118 and pitch hydraulic actuators 120 are double acting hydraulic cylinders. As such, each may exert a force in the extending or retracting direction, directing pressurized hydraulic fluid into a head chamber of the cylinder to exert a force in the extending direction. Whereas, directing pressurized hydraulic fluid into a rod chamber of the hydraulic cylinder will tend to exert a force in the retracting directions.

The reconfigurable grading blade attachment 110 may be operable to engage the ground surface 108 and grade, cut, and/or move material to achieve simple or complex features on the ground surface. When attached to and operating with a work machine 100, the grading blade attachment 110 may experience movement in three directions and rotation in three directions. A direction of the grading blade attachment 110 may also be referred to with regard to a longitudinal direction 102, a latitudinal or lateral direction 124, and a vertical direction 126. Rotation for grading blade attachment 110 may be referred to as roll 128 or the roll direction, pitch 130 or the pitch direction, and yaw 132 or the yaw direction. The grading blade attachment 110 may be hydraulically actuated to move vertically up and down ("lift"), roll left or right ("tilt"), and yaw left and right ("angle") as described in further detail below.

The terms "distal", "proximal", "left" and "right" may be used herein to describe certain features of the grading blade attachment 110. The terms "distal" and "proximal" are used in relation to the point of view of an operator located on or within the work machine 100. For example, a proximal end of the grading blade attachment 110 may be the end closest to the operator and the work machine 100. A distal end of the grading blade attachment 110 may be the end furthest from the operator and the work machine.

Figure 3:
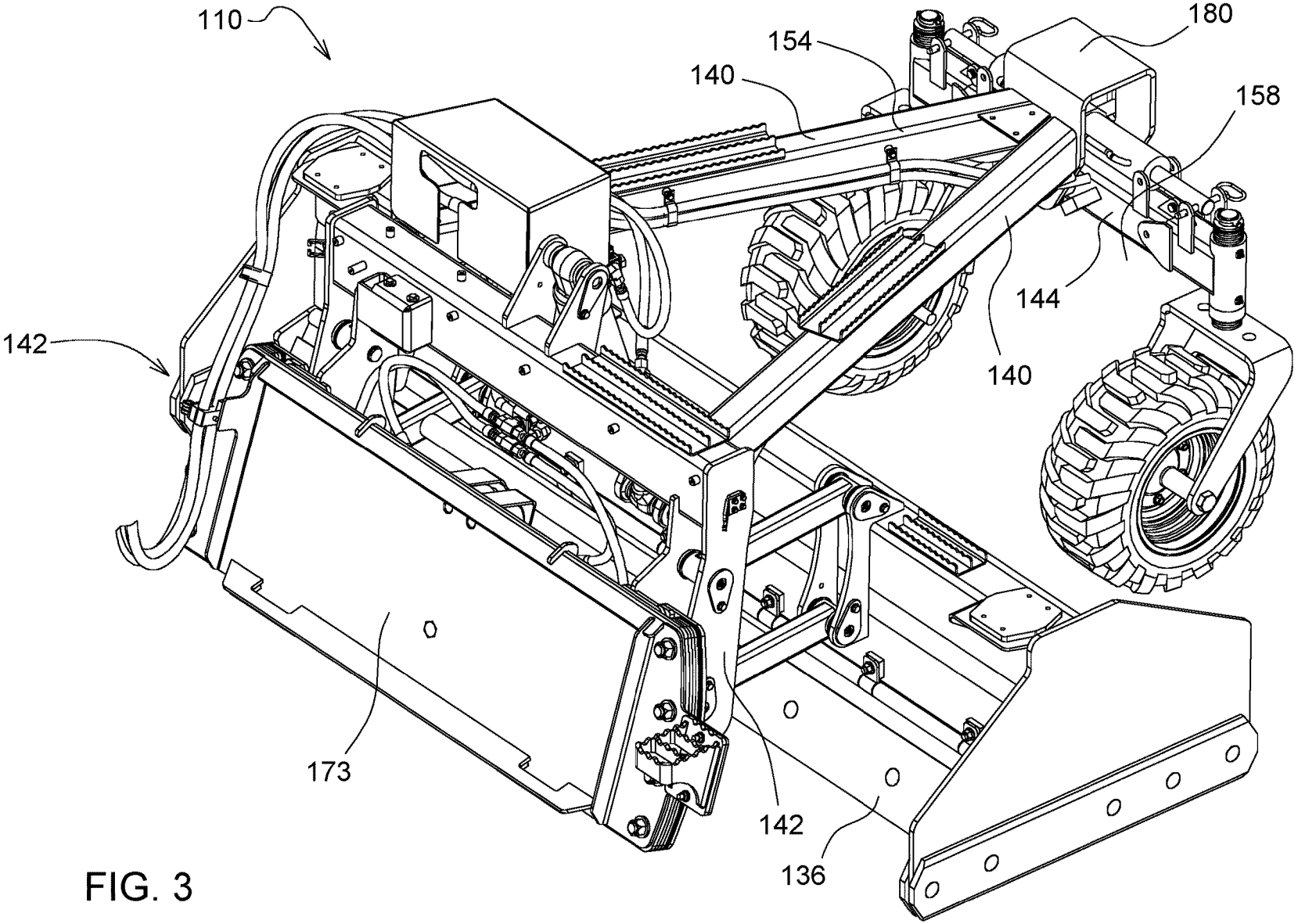
FIG. 3 is an isometric rear view of the reconfigurable grading blade attachment with the stabilizer wheels in a downward position.

The grading blade attachment 110 comprises of a grading blade 136 extending transversely to a length 105 of the work machine 100. The grading blade attachment 110 includes an upper attachment frame portion 140 and a rear attachment frame portion 142. The upper attachment frame portion 140 that has a frame length 138 extending forward from the rear attachment frame portion 142. As shown in at least FIGS. 1-3, a pivot beam 144 extends transversely to the frame length 138 and is pivotally coupled to the upper attachment frame portion 140 such that the pivot beam 144 is pivotable about a pivot beam axis 146 relative to the upper attachment frame portion 140. The pivot beam 144 has a left portion 148 and a right portion 150 wherein the direction of the pivot beam is indicated by arrows on opposite sides of the pivot beam axis 146. The pivot beam axis 146 can be defined as the coupling where pivot beam 144 tilts with respect to the upper attachment frame portion 140. It may be contemplated the each the left portion 148 and the right portion 150 mirror one another.

Now further referring to FIGS. 5 through 9, a left stabilizer wheel assembly 152 is pivotally coupled to the left portion 148 of the pivot beam 144 such that the left stabilizer wheel assembly 152 is pivotable about a left wheel lift axis 154 of a left hinge-like connector 198. A right stabilizer wheel assembly 156 is pivotally coupled to the right portion 150 of the pivot beam 144 such that the right stabilizer wheel assembly 156 is pivotable about right wheel lift axis 158 of a right hinge-like connector 199. Each hinge-like connecter (198, 199) extends upwardly from a surface of the pivot beam and towards the stabilizer wheel assemblies (152,156).

A center mount 160 comprises of at least a center mount block 192 and a center mount cover 180. The center mount block 192 is positioned vertically above the pivot beam 144. A left hydraulic actuator 162 and a right hydraulic actuator 168 are each coupled to opposing sides of the center mount 160. The disclosed embodiment shown in the exploded view of FIG. 7 includes the center mount block 192 with hydraulic actuators (162, 168) extending laterally from opposing sides of the center mount block 192. The block 192 is suspended within a center mount cover 180 portion of the center mount 160 wherein the center mount cover 180 is fixedly attached to the upper attachment frame portion 140. A fastener 194 pivotably couples the center mount cover 180 with the pivot beam 144 thereby allowing the pivot beam 144 to rotate about a fastener axis 196.

The left hydraulic actuator 162 is coupled to the center mount 160 on a first end 164 and coupled to the left stabilizer wheel assembly 152 on a second end 166, wherein retraction of the left hydraulic actuator 162 rotates the left stabilizer wheel assembly 152 upwards about the left wheel lift axis 154. The left hydraulic actuator 162 is secured to the top portion of the pivot beam 140.

A right hydraulic actuator 168 is coupled to the center mount 160 on a third end 170 and pivotally coupled to the right stabilizer wheel assembly 156 on a fourth end 172, wherein retraction of the right hydraulic actuator 168 rotates the right stabilizer wheel assembly 156 upwards about the right wheel lift axis 158. The right hydraulic actuator 168 is secured to the top portion of the pivot beam 140, similar to the left hydraulic actuator 162. The center mount 160 further includes a sliding mechanism 174 consisting of a forward extending protrusion 176 from the center mount block 192 seated within a vertical slide notch 178 located on an inner wall of the center mount cover 180 to prevent the center mount block 192 from moving transverse to the upper attachment frame 140 portion during actuation of the left hydraulic actuator 162 and/or the right hydraulic actuator 168.

The grading blade attachment 110 may further include a mechanical lock 182 consisting of a first aperture 184 on the pivot beam 144, a second aperture 186 on the stabilizer wheel assembly (152, 156), and a locking pin 188 adapted to engage the first aperture 184 and the second aperture 186 to lock the stabilizer wheel assembly (152, 156) in a downward position 190. The locking pins enable the mechanical securement of the stabilizer wheel assemblies when the first aperture 184 and the second aperture 186 align.

Figure 4:
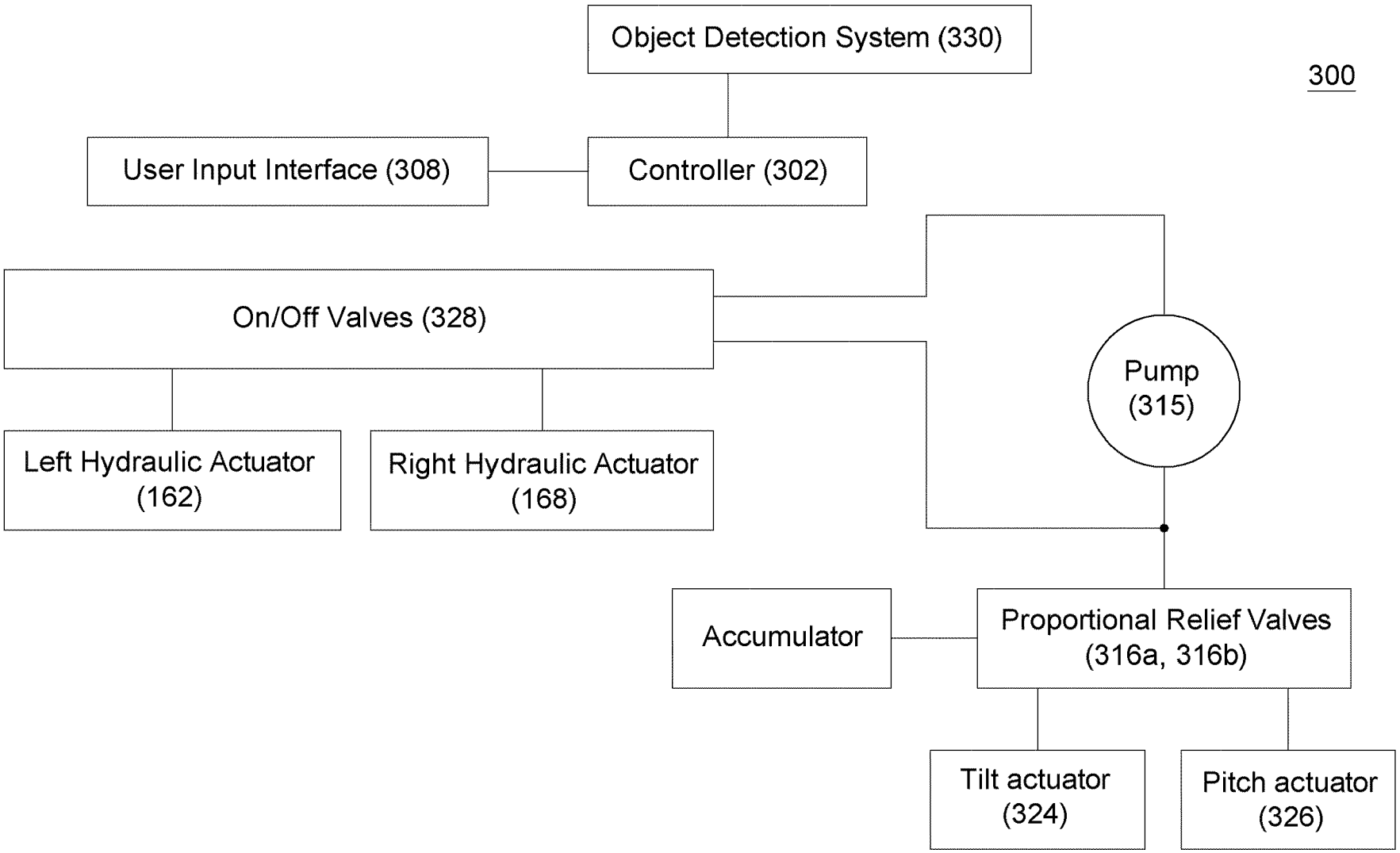
FIG. 4 is a schematic of the fine grading mode system.
Figure 5:
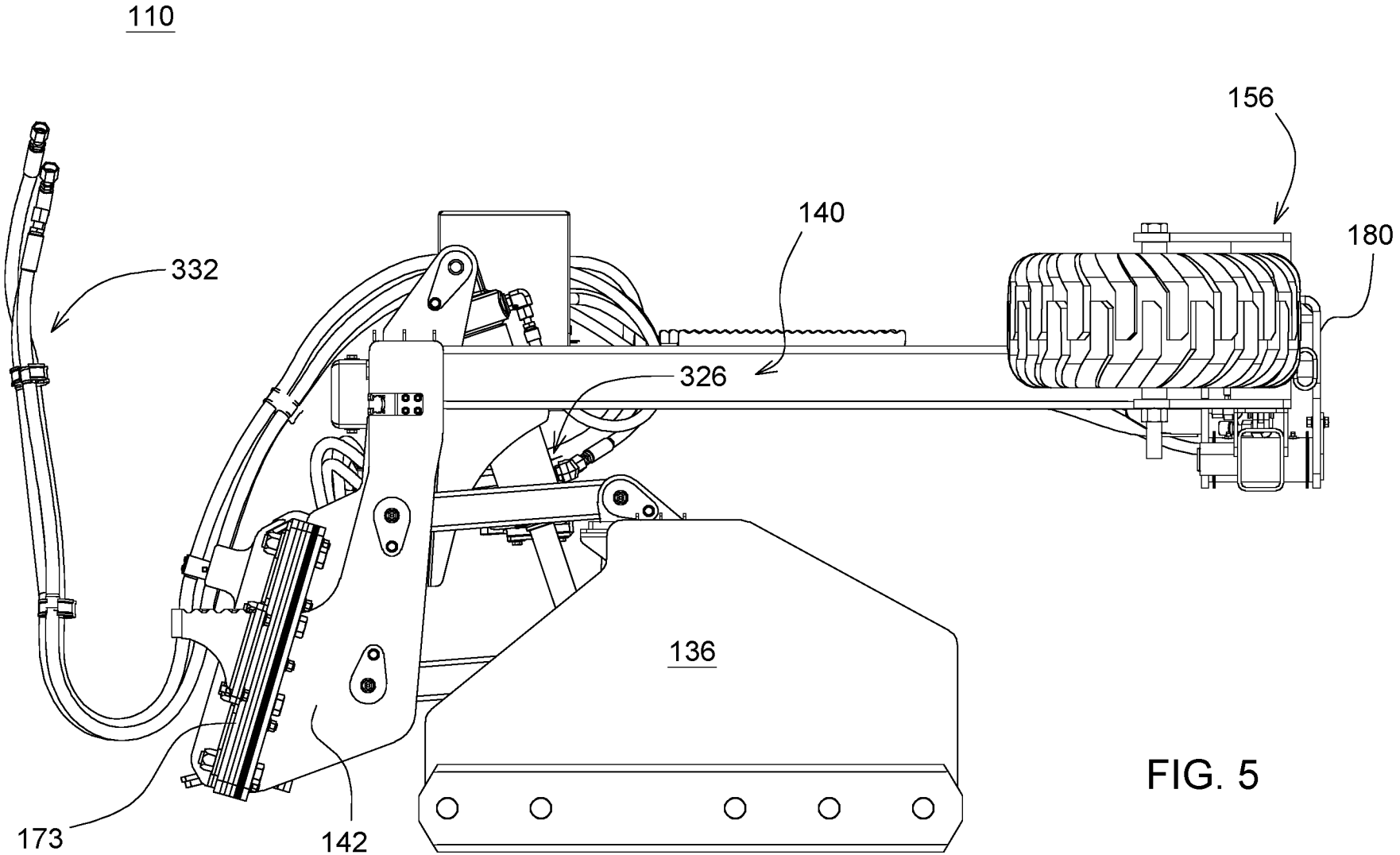
FIG. 5 is a side view of the reconfigurable grading blade attachment with the stabilizer wheels in an upward position.
Figure 6:
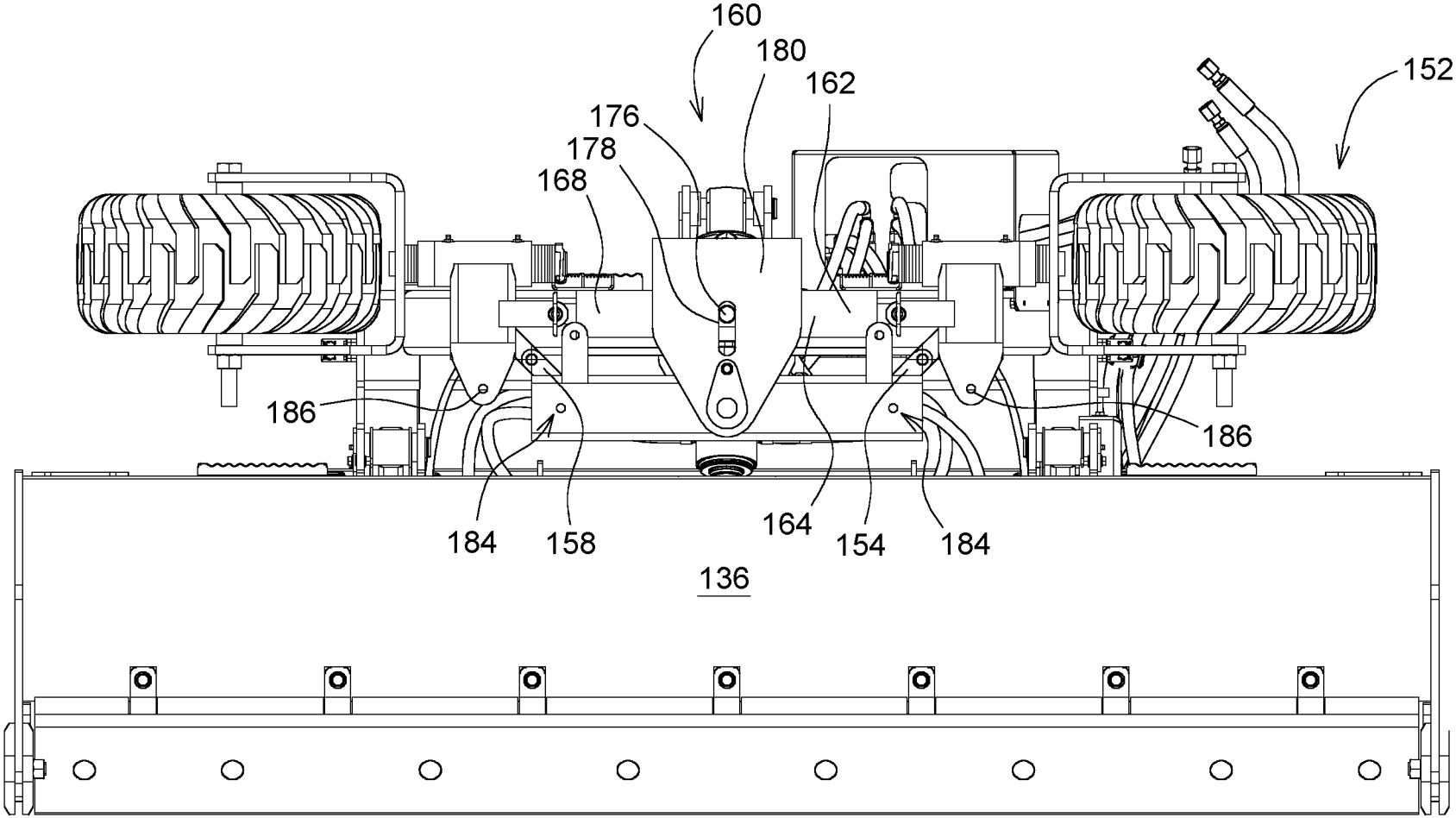
FIG. 6 is a front view of the reconfigurable grading blade attachment with the stabilizer wheels in an upward position.
Figure 7:
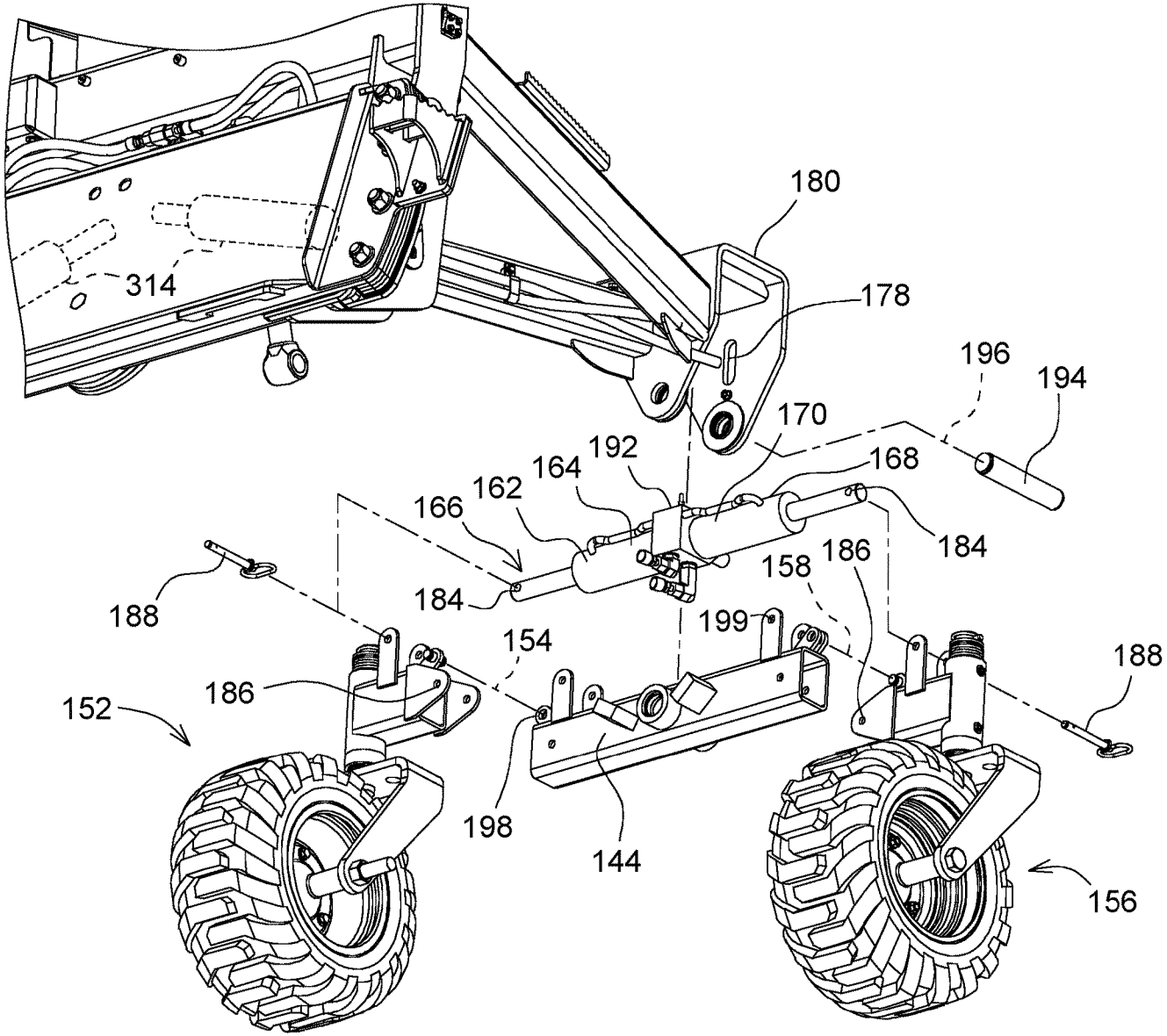
FIG. 7 is a detailed view of a portion of the lower rear isometric view of the reconfigurable grading blade attachment.
Figure 8:
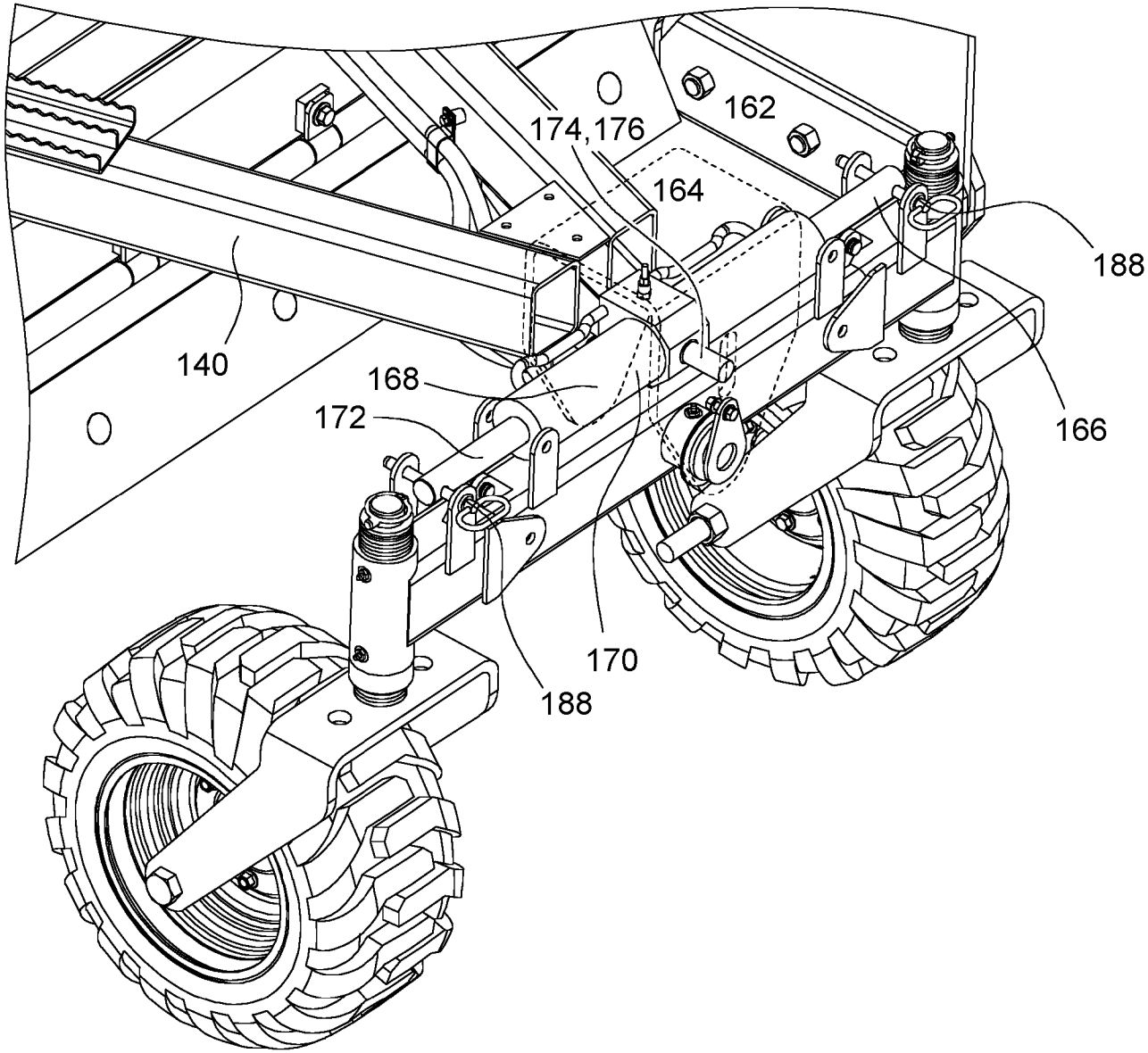
FIG. 8 is a detailed view of a portion of the front isometric view of the grading blade attachment without a center mount cover.
Figure 9:
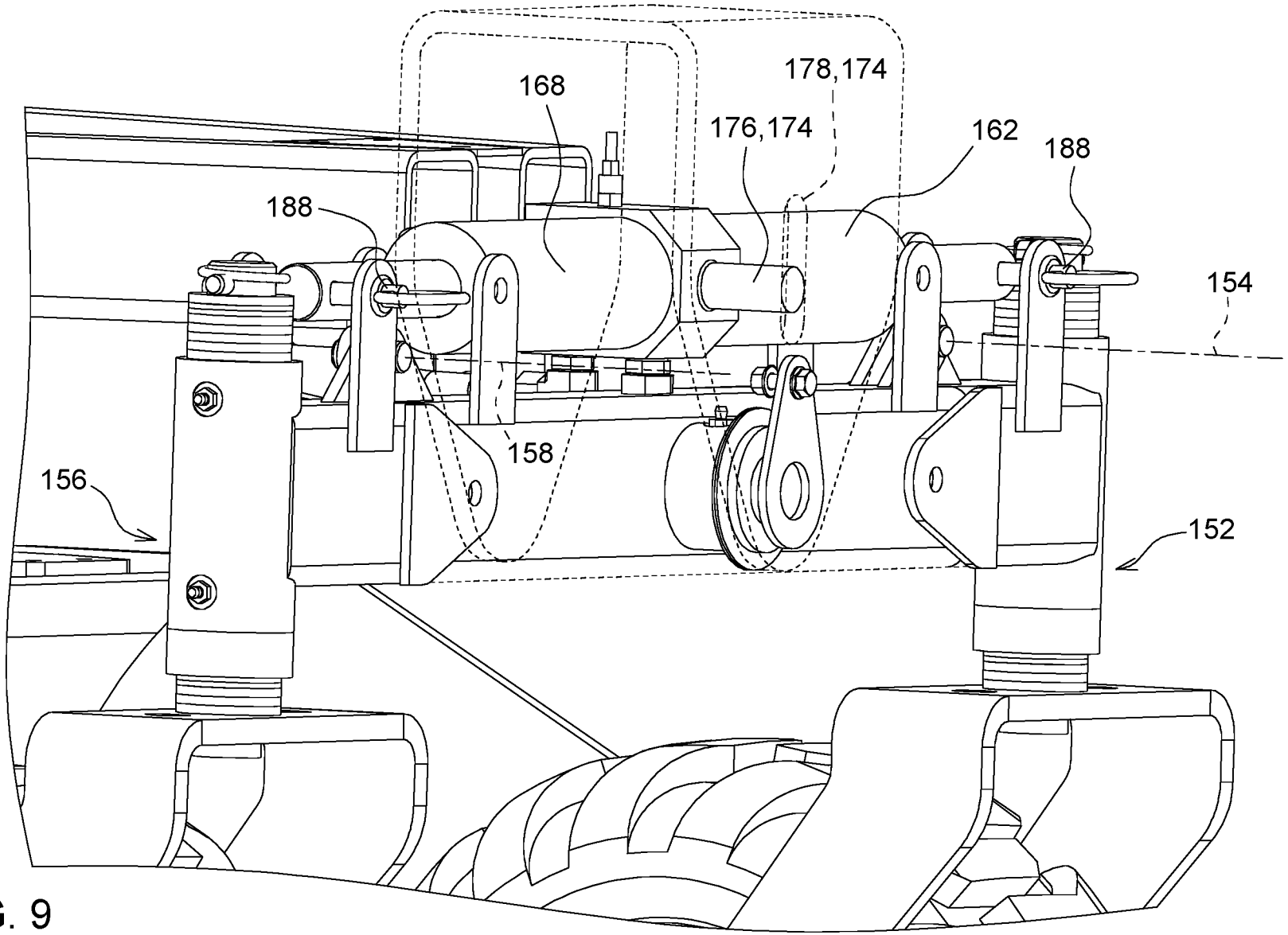
FIG. 9 is a detailed view of a portion of the grading blade attachment from FIG. 2.

FIG. 4 is an illustrative schematic of the fine grading mode system 300, including the hydraulic and electrical components for controlling a position of the grading blade attachment 110. The grading blade attachment 110 may also include one or more of a hydraulic lock and a soft lock mechanism 310 wherein the left hydraulic actuator 162 and the right hydraulic actuator 168 are communicatively coupled to a controller 302 on a work machine 100. The controller 302 is configured to transmit a lock signal 304 upon a user input request 306 from a user input interface 308 to inactive a portion of the hydraulic system 312 related to movement the left hydraulic actuator 162 and the right hydraulic actuator 168. The hydraulic lock is where a fluid impedes or prevents movement the hydraulic actuators. A soft lock is used in software systems to prevent access or modification to certain resources, data, or functionality such as actuator of a respective hydraulic actuator.

The left hydraulic actuator 162 and the right hydraulic actuator 168 may further be configured to selectively activate a portion of the hydraulic system 312 related to movement the left hydraulic actuator 162 and the right hydraulic actuator 168 upon a user input request 306 from a user input interface 308.

The upper attachment frame portion 140 is a single-piece component. The upper attachment frame portion 140 is not foldable. The solid, single-piece upper attachment frame portion 140 advantageously overcomes the drawback of current known methods that use a hinge joint to connect two parts of a bisected upper attachment frame portion wherein the hinge joint enables the folding upwards in the longitudinal direction of the first bisected half of the upper attachment frame to "stow" the stabilizer wheel assemblies. The solid, single-piece attachment frame disclosed herein eliminates the possibility of vulnerability in joint stiffness and increased stress concentrations found in hinge joints. This improvement may be substantive in components that encounter large forces in the longitudinal direction, as found in fine grading operations.

The grading blade attachment 110 includes a coupler bracket 173 attached to the rear attachment frame portion 142. The coupler bracket 173 may include an attachment interface for coupling the grading blade attachment 110 to the work machine 100. Specifically, the attachment interface may be operable to be engaged by the attachment coupler 114 of the work machine 100. The coupler bracket 173 may include a tilt plate extending transversely to the frame length 105 and positioned adjacent to the attachment coupler 114 interface. The grading blade attachment 110 also introduces an attachment tilt cylinder 324 and an attachment pitch cylinder 326 as the lift and pitch cylinder positions on the work machine are secured during operation of grading blade attachment 110. The grading blade attachment is hydraulically coupled to the work machine 100 through hoses that couple to an auxiliary hydraulic port on the work machine.

Now returning to the hydraulic system, each of the attachment pitch actuators 326 and attachment tilt actuators 324 on the grading blade attachment 110 are hydraulically coupled to a proportional relief valve (316*a*, 316*b*) each. The proportional relief valves 316 receive pressurized fluid from a hydraulic pump 315 and directs such fluid to the attachment pitch actuators 326 and the attachment tilt actuators 324. The proportional relief valve 316 may meter such fluid out or control the flow rate of hydraulic fluid to each hydraulic circuit 322 to which it is connected. A proportional relief valve 316 is designed to maintain a consistent pressure by releasing excess fluid when pressure in the system exceeds a certain level. A proportional relief valve 316 may respond to changes in pressure in a linear or proportional manner wherein as the pressure in the system 312 increases, the proportional relief valve 316 will gradually open to release more fluid, and as the pressure decreases, the valve 316 will gradually close to limit fluid flow, thereby advantageously improving precision. The hydraulic actuators such as the attachment pitch actuators 326 and the attachment tilt actuators 324 are coupled to the outlet of the proportional relief valves (316*a*, 316*b*). It regulates fluid flow to control the speed and force of the actuator. The flow rate and thereby pressure is determined by the size of the valve opening. The inclusion of the proportional relief valve 316 coupled to an accumulator 320 advantageously helps keep the system 300 stable and minimizes pressure fluctuations during sudden changes in the ground surface 108 and terrain and maintains a controlled performance of the hydraulic actuators. Contrary to this mechanism, the left hydraulic actuator and the right hydraulic actuator comprise of an on/off valve 328 enabling the movement of the right wheel stabilizer wheel assembly 156 and the left wheel stabilizer wheel assembly 152 in one of two positions (i.e. upwards or downwards). In another embodiment, the reconfigurable grading blade attachment 110 may be communicatively coupled to an object detection system 330, wherein one or more the right stabilizer wheel assembly 156 and the left stabilizer wheel assembly 152 may rotate upwards upon detecting an object in its travel path.

While the above describes example embodiments of the present disclosure, these descriptions should not be viewed in a limiting sense. Rather, other variations and modifications may be made without departing from the scope and spirit of the present disclosure as defined in the appended claims.

What is claimed is:

1. A reconfigurable grading blade attachment for a work machine, the attachment comprising:

an attachment frame including an upper attachment frame portion and a rear attachment frame portion, the upper attachment frame portion having a frame length extending forward from the rear attachment frame portion;

a coupler bracket including an attachment interface for coupling the grading blade attachment to the work machine;

a pivot beam extending transversely to the frame length and pivotally coupled to the upper attachment frame portion such that the pivot beam is pivotable about a pivot beam axis relative to the upper attachment frame portion, the pivot beam having a left portion and a right portion on opposite sides of the pivot beam axis;

a left stabilizer wheel assembly pivotally coupled to the left portion of the pivot beam such that the left stabilizer wheel assembly is pivotable about a left wheel lift axis;

a right stabilizer wheel pivotally coupled to the right portion of the pivot beam such that the right stabilizer wheel assembly is pivotable about a right wheel lift axis;

a center mount positioned vertically above the pivot beam;

a left hydraulic actuator coupled to the center mount on a first end and coupled to the left stabilizer wheel assembly on a second end, wherein retraction of the left hydraulic actuator rotates the left stabilizer wheel assembly upwards about the left wheel lift axis;

a right hydraulic actuator coupled to the center mount on a third end and pivotally coupled to the right stabilizer wheel assembly on a fourth end, wherein retraction of the right hydraulic actuator rotates the right stabilizer wheel assembly upwards about the right wheel lift axis; and a grading blade extending transversely to a length of the work machine frame.

2. The grading blade attachment of claim 1 wherein the center mount further comprises of a sliding mechanism consisting of a forward extending protrusion from a center mount block seated within a vertical slide notch located within a center mount cover to prevent the center mount from moving transverse to the upper attachment frame portion during an actuation of the left hydraulic actuator and the right hydraulic actuator.

3. The grading blade attachment of claim 1, further comprising of a mechanical lock consisting of a first aperture on the pivot beam, a second aperture on the stabilizer wheel assembly, and a locking pin adapted to engage the first aperture and the second aperture to lock the stabilizer wheel assembly in a downward position.

4. The grading blade attachment of claim 1, further comprising of a one or more of a hydraulic lock and a soft lock mechanism wherein the left hydraulic actuator and the right hydraulic actuator are communicatively coupled to a controller on the work machine, the controller configured to transmit a lock signal upon a user input request from a user input interface to inactivate a portion of a hydraulic system related to movement of the left hydraulic actuator and the right hydraulic actuator.

5. The grading blade attachment of claim 1, wherein the left hydraulic actuator and the right hydraulic actuator are communicatively coupled to a controller, the controller configured to selectively activate a portion of a hydraulic system related to movement of the left hydraulic actuator and the right hydraulic actuator upon a user input request from a user input interface.

6. The grading blade attachment of claim 1, wherein the upper attachment frame portion is a single-piece component.

7. The grading blade attachment of claim 1, wherein the grading blade is a grading box.

8. The grading blade attachment of claim 1, wherein the left hydraulic actuator and the right hydraulic actuator are communicatively coupled to a controller, the controller configured to selectively activate a portion of a hydraulic system related to movement of the left hydraulic actuator and the right hydraulic actuator in response to an object detection system.

9. The grading blade attachment of claim 1 further comprising of a mechanical lock consisting of a first aperture on the pivot beam, a second aperture on the hydraulic actuator, and a locking pin adapted to engage the first aperture and the second aperture to lock the stabilizer wheel assembly in a downward position.

10. The grading blade attachment of claim 1 wherein the upper attachment frame portion is not foldable.

11. A work machine with a reconfigurable grading blade attachment, the work machine comprising of:

a frame supported by a plurality of ground-engaging units, the ground-engaging units configured to support the frame on a surface;

a boom assembly coupled to the frame, the boom assembly having a pair of boom arms pivotally coupled to the frame and movable relative to the frame by a pair of boom hydraulic actuators;

an attachment coupler coupled to a distal portion of the pair of boom arms, the attachment coupler movable relative to the frame by a pair of attachment pitch hydraulic actuators;

a grading blade coupled to the attachment coupler, the grading blade extending transversely to a frame length;

an attachment frame including an upper attachment frame portion and a rear attachment frame portion, the upper attachment frame portion having a frame length extending forward from the rear attachment frame portion;

a pivot beam extending transversely to the attachment frame length and pivotally coupled to the upper attachment frame portion such that the pivot beam is pivotable about a pivot beam axis relative to the upper attachment frame portion, the pivot beam having a left portion and a right portion on opposite sides of the pivot beam axis;

a left stabilizer wheel assembly pivotally coupled to the left portion of the pivot beam such that the left stabilizer wheel assembly is pivotable about a left wheel lift axis;

a right stabilizer wheel pivotally coupled to the right portion of the pivot beam such that the right stabilizer wheel assembly is pivotable about a right wheel lift axis;

a center mount positioned vertically from the pivot beam;

a left hydraulic actuator coupled to the center mount on a first end and coupled to the left stabilizer wheel assembly on a second end, wherein retraction of the left hydraulic actuator rotates the left stabilizer wheel assembly upwards about the left wheel lift axis;

a right hydraulic actuator coupled to the center mount on a third end and pivotally coupled to the right stabilizer wheel assembly on a fourth end, wherein retraction of the right hydraulic actuator rotates the right stabilizer wheel assembly upwards about the right wheel lift axis;

a positioning unit configured to at least raise or lower the stabilizer wheel assemblies via the left hydraulic actuators and the right hydraulic actuator;

a hydraulic circuit communicatively coupled to a controller, the hydraulic circuit including a hydraulic pump coupled to the left hydraulic actuator and the right hydraulic actuator, the hydraulic pump delivering fluid through a plurality of flow paths, the plurality of flow paths coupled the left hydraulic actuator, the right hydraulic actuator, and at least one proportional valve; and the controller functionally linked to the positioning unit, and configured to selectively adjust the at least one proportional valve as a function of input signal corresponding to a desired grading blade attachment configuration to be generated by the left hydraulic actuators and the right hydraulic actuators to position the left stabilizer wheel assembly and the right stabilizer wheel assembly with respect to the ground surface; the controller automatically controlling the at least one proportional valve to achieve the desired grading blade attachment configuration.

12. The work machine of claim 11 further comprising a user input interface communicatively coupled to the controller, the user input interface enabling an operator to command the desired grading blade attachment configuration.

13. The work machine of claim 11 wherein the center mount further comprises of a sliding mechanism consisting of a forward extending protrusion from the center mount block seated within a vertical slide notch locating within a center mount cover to prevent the center mount from moving transverse to the upper attachment frame portion during an actuation of the left hydraulic actuator or the right hydraulic actuator.

14. The work machine of claim 11 further comprising of a mechanical lock consisting of a first aperture on the pivot beam, a second aperture on the stabilizer wheel assembly, and a locking pin adapted to engage the first aperture and the second aperture to lock the stabilizer wheel assembly in a downward position.

15. The work machine of claim 11, further comprising of a one or more of a hydraulic lock and a soft lock mechanism wherein the left hydraulic actuator and the right hydraulic actuator are communicatively coupled to a controller on the work machine, the controller configured to transmit a lock signal upon a user input request from a user input interface to inactivate a portion of a hydraulic system related to movement of the left hydraulic actuator and the right hydraulic actuator.

16. The work machine of claim 11, wherein the left hydraulic actuator and the right hydraulic actuator are communicatively coupled to a controller, the controller configured to selectively activate a portion of a hydraulic system related to movement of the left hydraulic actuator and the right hydraulic actuator upon a user input request from a user input interface.

17. The work machine of claim 11, wherein the upper attachment frame portion is a single-piece component.

18. The work machine of claim 11, wherein the left hydraulic actuator and the right hydraulic actuator are communicatively coupled to a controller, the controller configured to selectively activate a portion of a hydraulic system related to movement of the left hydraulic actuator and the right hydraulic actuator in response to an object detection system.

19. The work machine of claim 11 further comprising of a mechanical lock consisting of a first aperture on the pivot beam, a second aperture on the hydraulic actuator, and a locking pin adapted to engage the first aperture and the second aperture to lock the stabilizer wheel assembly in a downward position.

20. The work machine of claim 11 wherein the upper attachment frame portion is not foldable.

* * * * *